United States Patent [19]

Mendenhall

[11] 4,095,284

[45] June 13, 1978

[54] DIRECT HEATING ASPHALT-AGGREGATE RECYCLE APPARATUS AND METHOD

[76] Inventor: Robert L. Mendenhall, 1770 Industrial Rd., Las Vegas, Nev. 89102

[21] Appl. No.: 754,315

[22] Filed: Dec. 27, 1976

Related U.S. Application Data

[63] Continuation-in-part of Ser. No. 603,357, Aug. 11, 1975, Pat. No. 3,999,743, and a continuation-in-part of Ser. No. 729,705, Oct. 5, 1976.

[51] Int. Cl.[2] ..... B28C 5/20

[52] U.S. Cl. ..... 366/7; 366/25; 366/33; 366/154; 366/180; 366/225

[58] Field of Search ..... 259/3, 146, 148, 147, 259/149, 155, 156, 157, 158, 159 R, 159 A, 161, 175, 176, 177 R, 177 A, 14, 30, 81 R

[56] References Cited

U.S. PATENT DOCUMENTS

| | | | |
|---|---|---|---|
| 1,363,561 | 12/1920 | Browne | 259/157 |
| 1,734,981 | 11/1929 | Philips | 259/175 |
| 3,321,186 | 5/1967 | Lodige | 259/3 |
| 3,693,945 | 9/1972 | Brock | 259/158 |
| 3,737,149 | 6/1973 | Muntzer | 259/146 |

*Primary Examiner*—Robert W. Jenkins
*Attorney, Agent, or Firm*—Seiler & Quirk

[57] ABSTRACT

In an apparatus for heating and mixing asphalt-aggregate composition in which composition particles are exposed directly to hot gases of combustion, a plurality of lifters are secured around the drum interior surface adjacent the input end of the apparatus where flame and hot gases of combustion are supplied, opposite the output end, and a space is provided between the lifter surface and the interior drum surface, whereby coarse composition particles are alternately lifted and dropped by the lifters as the drum rotates, and any fine composition particles pass along the space between the lifter and drum interior surfaces. In another embodiment, a barrier plate is provided across the hollow drum interior, and having peripheral edge spaced apart from the drum interior surface, and behind which plate fine composition particles are introduced.

9 Claims, 3 Drawing Figures

DIRECT HEATING ASPHALT-AGGREGATE RECYCLE APPARATUS AND METHOD

This application is a continuation-in-part of my co-pending application Ser. No. 603,357, filed Aug. 11, 1975, now U.S. Pat. No. 3,999,743, and application Ser. No. 729,705, filed Oct. 5, 1976.

BACKGROUND OF THE INVENTION

In my aforesaid co-pending applications there are described apparatus and methods for treating used asphalt-aggregate compositions. Particularly, these compositions are described as being crushed and separated into the various particle size ranges. The coarse particles are introduced into the heating apparatus in a hot zone, normally adjacent the drum end into which flame and hot gases of combustion are supplied, opposite the cooler output apparatus end. Smaller particles are separately introduced downstream from the hot drum end toward the cooler drum end, in a cooler zone whereby burning of the more readily heated asphalt containing particles is avoided. The compositions are normally separated into two or more particle size ranges. The description of the particle size ranges used in the process of the invention is the same as disclosed in my aforesaid co-pending applications, and is incorporated herein by reference.

Although it is understood that the coarse particles themselves will not become as readily heated as smaller size particles because of the difference in the ratio of the surface area and the mass of the particle, when introducing coarse particles in the hottest area of the drum, it has been found that some fine particles are also present, due to incomplete separation of the particles. The relatively fine particles present in the coarse particle size range may also result from break up of coarse particles during transfer from the stockpile to the drum, as they are handled by scoops, conveyors, and the like. Thus, even with efficient separation of crushed asphalt-aggregate particles into various size ranges, because of the necessary handling and transfer of these compositions between storage areas and from stockpiles to the heating and mixing apparatus, some particles sizes outside any given range may be formed, especially fine particles from the coarse and intermediate particles. The presence of fine particles presents a more serious problem when introducing coarse particles into the hottest apparatus end where they are exposed directly to the hot gases of combustion and flame supplied. Although the coarse particles which are alternately lifted and dropped in a cascade fashion through these hot gases are not burned but become more slowly heated, as described in my aforesaid co-pending applications, fine particles so treated may become rapidly overheated in the 1,000°–2,000° F or more temperatures, causing burning of the asphalt and concomitant smoke and asphalt degradation. It is to the elimination of these problems that the present invention is directed.

SUMMARY OF THE INVENTION

The present invention is directed to apparatus and means for reducing burning of fine asphalt containing particles which may be present with coarse composition particles introduced in the hot end or hot zone in a heating and mixing apparatus for asphalt-aggregate composition where particles are exposed directly to hot gases of combustion. The improvement of the apparatus comprises providing a plurality of lifters along the drum interior surface adjacent the hot apparatus end and extending therealong toward a cooler zone, and which lifters are spaced apart from or separated from the interior drum surface leaving a space therebetween. This space allows much of the fine asphalt containing particles present with the coarse material to pass along the interior drum surface rather than being elevated by lifters and dropped and cascading directly through the hot gases of combustion with the coarse particles.

In another embodiment, a barrier plate is provided between the hot drum input end and the cooler output end, and which plate has a peripheral edge spaced apart from the interior drum surface so that asphalt-aggregate composition can pass therebetween. On the cool side of the plate, i.e., on the plate side facing the cool output drum end, there will be a zone of reduced gas flow draft. Moreover, the plate will shield that area of the drum behind it from infra red heat and rays from the flame at the hot output end. Accordingly, this reduced draft and infra red protected portion of the drum is most suitable for introducing fine composition particles, which could otherwise be picked up by the strong gas stream passing to the output drum end, and which particles would be exhausted and lost through the gas exhaust apparatus. Moreover, very fine composition particles may be quickly overheated if exposed to infra red radiation from the flame, and this is also avoided utilizing the plate. Accordingly, in this embodiment, the smallest composition particles are introduced behind this barrier plate, and make-up asphalt and aromatic oil softening agent is supplied in this cool zone.

DETAILED DESCRIPTION OF THE INVENTION

Figure 1:
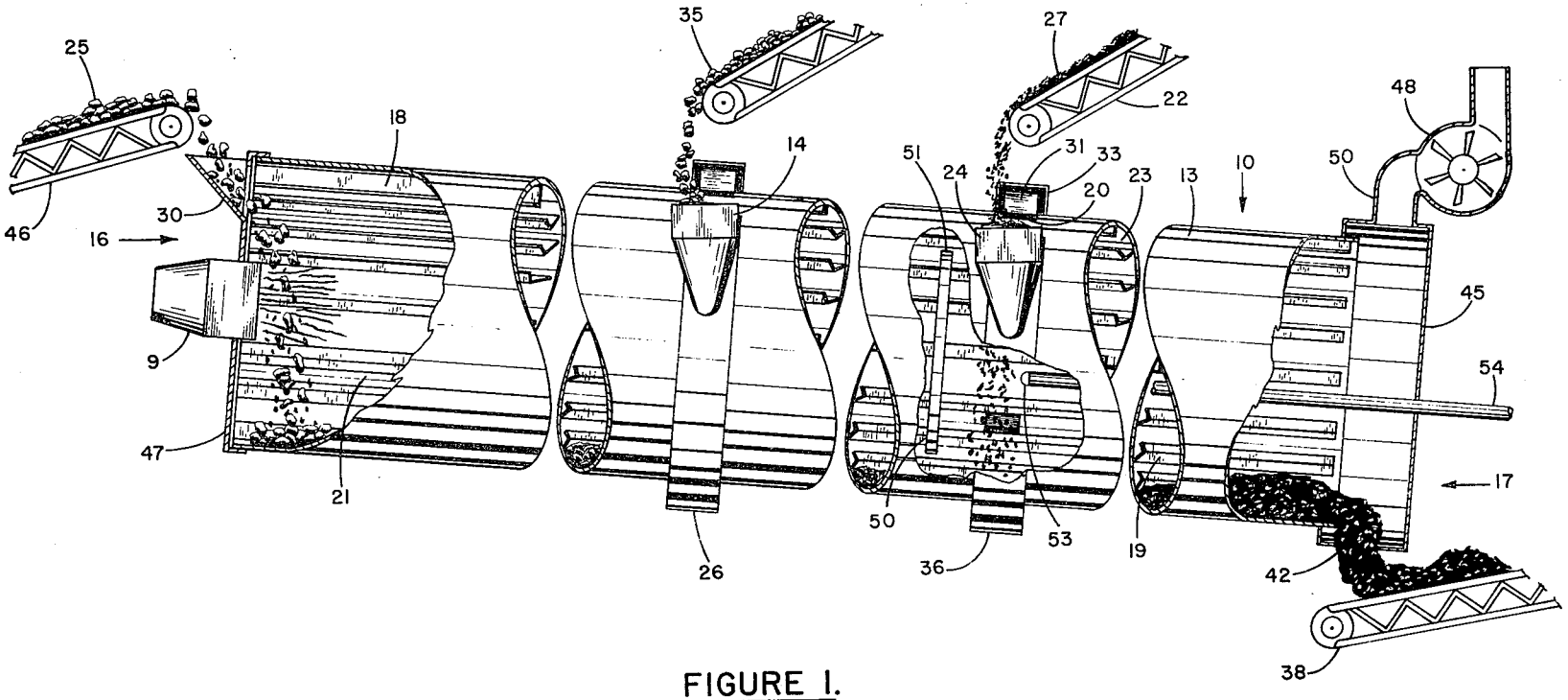
FIG. 1 illustrates the apparatus of the invention partially in section and partially cut away, showing the improved features thereof.

The apparatus of the invention comprises an elongated cylindrical drum 13 which is rotatable along its elongated axis by means (not shown) well known to those skilled in the art. The overall apparatus is generally described in my aforesaid co-pending application Ser. No. 603,357 concerning the plurality of means for introducing different particle size ranges, and which description is incorporated herein by reference. The rotatable dryer-type drum 10 has an outer cylindrical cover or surface 13, a stationary input end wall 47, and a stationary output end cover 45, enclosing the hollow interior drum chamber. Secured along a portion of the interior drum surface length are a plurality of elongated lifters or flights 19. These lifters preferably extend the majority of the length, from the forward or output drum end rearwardly. These lifters terminate at approximately the hot drum zone 21 which may be defined herein as the hottest zone of the drum between the input end wall 47 and the area in which the next smaller sized particles are introduced downstream or toward the output apparatus end 17 from the area in which the coarse particles are introduced. In the apparatus shown, the hot drum area 21 is located between the input end wall 47 and the ring of openings around the drum wall 13 which are covered by trough 26. Moreover, any single filter 19 need not extend the entire length between the trough 26 and the forward or output apparatus end 17. Instead, these state of the art lifters may extend only a portion of that length and be staggered.

Figure 3:
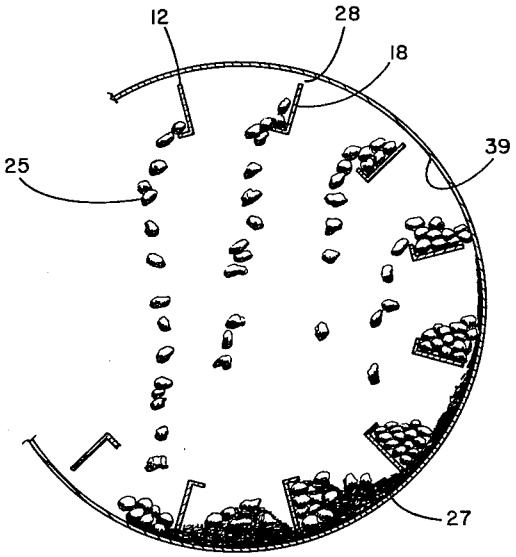
FIG. 3 is a partial sectional view of the apparatus interior illustrating the coarse particle lifting and dropping action and the movement of fine composition particles behind the lifters.
Figure 2:
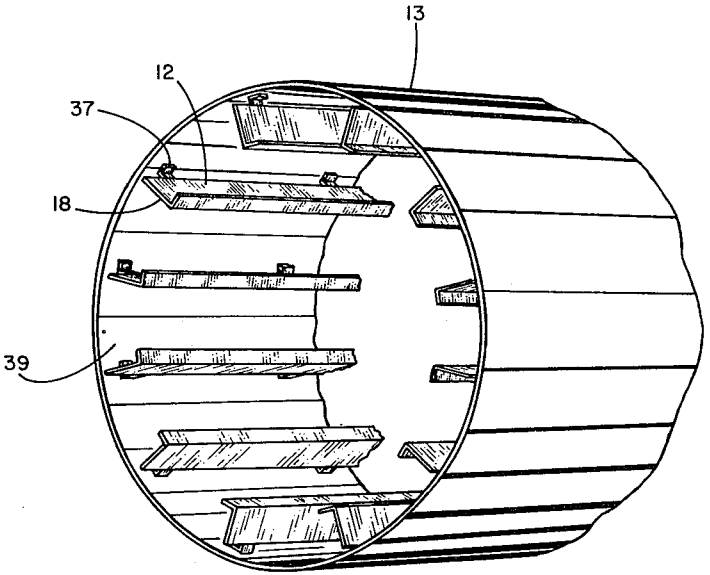
FIG. 2 is a partial view of the interior of one end of the apparatus illustrating the lifters.

The improved lifters of the invention are located in the hot apparatus area 21 between input end wall 47 and the area defined by annular trough 26, which covers the ports or openings in the drum outer wall for introducing smaller particles therein. These improved lifters 18 are shown more particularly in FIGS. 2 and 3 and are secured to the interior drum surface 39 by any suitable means such as brackets or braces 37. The lifters themselves may be substantially identical or similar to the lifters 19 which extend along the cooler drum interior surface areas, but are distinguished in that they are spaced apart from the drum surface. This may be observed particularly in FIGS. 2 and 3 where lifters 18 have a rear edge 12, which defines the terminating edge of the lifter surface extending along adjacent the interior drum surface. Again, this edge is separated or spaced from the interior drum surface 39, preferably uniformly, thereby leaving a space 12. It is this space which provides the improved efficiency and advantage of the apparatus in the asphalt-aggregate heating process according to the invention. This improvement is realized as coarse composition particles 25 are introduced via chute 30 or other equivalent means for introducing composition at the hot input end 16 of the apparatus. These coarse composition particles 25 cascade through the hot gases of combustion, fall gravitationally to the bottom of the rotating drum, and as the drum rotates, are alternately lifted or elevated along the side by the lifters, and then dropped as the forward lifters passes through a horizontal plane.

As previously explained, due to normal screening or separation techniques and equipment, some smaller asphalt containing particles will remain in the coarse particle range. Moreover, even if precise separation equipment techniques are used, some fine composition particles may be created by inadvertent crushing of the coarse particles as they are moved, handled and treated prior to introduction in the heating drum. It is these fine particles which are present, even in small amounts, with the coarse particles, which become burned or otherwise overheated as they would be exposed to the intense heat of the hot area 21 of the apparatus. Such overheating is most difficult to avoid, where these small particles are continuously and alternately elevated and dropped along with coarse particles in the apparatus used heretofore. However, utilizing the apparatus of the invention, with the spacing between the rear edge of the lifters and the interior drum surface, the smaller or fine particles will quickly sift through the coarse particles and come to rest along the drum interior surface. Then, as the drum is rotated, these fine particles 27 (FIG. 3) will pass in the space 28 between the rear lifter edge 12 and the interior drum surface 39, and thus will be insulated somewhat by the overlying coarse composition particles.

The distance between the rear lifter edge and the interior drum surface may be between about ½ and about 4 inches, preferably between about 1 and about 3 inches. A spacing or separation between the lifter and the interior drum surface of this size will be great enough to allow for the fines to pass therebetween. Greater spacing may be used where greater amounts of fines are present with the coarse particles. Even though the spacing will be large enough to allow for some coarse particles to also pass therethrough, i.e., No. 4 U.S. Series, ⅜, or ½ inch only a minor proportion of such particles will do so, since because of their greater size, they will tend to become directed to the outermost part of the composition mass.

Observing further the apparatus, a burner 9 is suitably located adjacent stationary input end wall 47 so as to supply hot gases of combustion directly into the drum 10. These hot gases of combustion are then directed through the length of the interior drum chamber and exhausted at the output drum end 17 through exhaust stack 50 by fan 48. In a preferred apparatus, a plurality of zones or areas are used to introduce composition particles smaller than the coarse particles 25. Such apparatus is disclosed in my aforesaid copending applications, and the description thereof is incorporated herein by reference. For example, where three composition introduction zones are used, the coarse composition is introduced at or adjacent the input end wall 47, a chute 30 being used for such a purpose. Intermediate sized particles 35 are introduced downstream or in a cooler zone through a chute 14 and fine composition particles 27 be introduced into chute 24, even some distance forwardly or further downstream toward the cooler output end of the apparatus from the input end. Where two particle size ranges are instead used, coarse particles may be introduced via chute 30, and fine particles introduced via chute 14 or chute 24. However, for multiple particle size introduction zones two or more zones may be selected although it will usually be no more than four. The selection of the zone or distance downstream from the input end wall in which fine particles are introduced will depend on the size range of the fine particles and the temperature of the hot gases as they reach that area of the drum. It is understood that it is the primary purpose to avoid overheating the small particles which will become quickly overheated as compared to the larger aggregate particles which are greater "sinks" for absorbing heat. Moreover, the drum of FIG. 1 is shown as segmented to illustrate that drum lengths between the different zones may be used to achieve the desired heating efficiency.

Where the compositions are separated into two size ranges, coarse particles may be those retained by a No. 4 U.S. Series sieve while fine particles will pass the No. 4 sieve. Another example of two particle size range separation are those in which the coarse grade may be those nominally ¼ or ⅜ inch and larger, the fines being particles which will pass sieve openings of those size. When it is desired to separate the composition into three different size ranges, one example of coarse particles will be those retained by a ⅜ inch sieve, fine particles which will pass a No. 8 U.S. Series sieve, and intermediate size particles as those passing the ⅜ inch sieve but retained by the No. 8 sieve. Another example of suitable three particle size portions are those in which coarse particles will be nominally ½ inch in diameter and larger, small or fine particles passing a No. 8 U.S. Series sieve, and intermediate particles passing the ½ inch but being retained by the No. 8 U.S. Series sieve. Such particle size ranges are more fully disclosed in my aforesaid applications Ser. Nos. 603,357 and 729,705, which descriptions are incorporated herein by reference.

The means for introducing composition particles in the apparatus may be any suitable method, conveniently incorporating one or more conveyor devices as shown, and with the composition being directed into a chute or hopper which communicates with the drum interior. Although a chute 30 is conveniently used at the stationary input end wall 47, a most suitable means comprises a scoop secured to the drum exterior cooperating with the trough into which the composition is placed as illustrated regarding composition particles 35 and 27. For example, a plurality of spaced ports may be located around the drum surface which open directly into the drum interior. A scoop 31 is secured to the drum exterior overlying each port 20, the scoops having a cavity which communicate with the port and an edge for engaging composition particles as the drum rotates. A trough 36 extends around the drum covering the scoops and ports and forms a cavity into which the composition is directed from conveyor 22 via chute 24. The aggregate particles introduced through the chute fall into the trough and are picked up by the scoops as the drum rotates and then fall gravitationally through the ports 20 into the drum interior. This same means for introducing composition is shown regarding chute 14 and trough 26, and may further be used for introducing coarse composition particles at the input end rather than utilizing the chute 30 shown. More specific details of the preferred scoops, ports and troughs may be found in applicant's co-pending applications Ser. No. 601,177, filed Aug. 1, 1975, which description is incorporated herein by reference.

Although the improved lifters are shown utilizing an apparatus having a plurality of zones for introducing different sized composition particles ranging from coarse to fine, wherein the coarse particles are introduced at the input or hot drum end, and finer composition particles are introduced downstream in a cooler zone therefrom, it should be understood that these improved lifters may be used in any apparatus for the advantage intended and disclosed herein, i.e., the prevention of burning or otherwise overheating fine composition particles when introduced with coarse particles without regard to smaller particle size ranges being introduced separately downstream in the apparatus. Thus, the lifters of the invention may be advantageously used in any apparatus where asphalt-aggregate compositions are heated in the presence of hot gases which would otherwise quickly overheat the smaller composition particles, but not the coarse composition particles so introduced at the same time. Accordingly, the broader aspect of the invention utilizing the lifters of the invention in the hot zone of the apparatus without regard to introducing smaller size particles separately in one or more cooler zones will be understood.

Regardless of the number of zones in which composition particles are introduced, the improved lifters of the invention, so spaced apart from the interior drum wall or surface need only extend from the input drum end, or other position where the coarse composition particles having some small particles therewith are introduced, toward the cooler end only so far as the drum interior becomes cool enough so that the small composition particles can then be elevated and dropped in a cascading fashion through the gases of combustion. This specific point will depend on the size of the small particles and the temperature of the gases at any particular location along the drum interior. For example, where the fines can stand repeated exposure to gas temperature of up to 800° F, preferably the improved and spaced lifters will extend along the drum interior length until a temperature of 800° F and below is reached along the drum length. When very fine and easily overheated particles are present, it may be advantageous to extend these lifters from the input end to a barrier plate 50 as shown, behind which the drum is cooler and where there is no danger of infra red radiation overheating.

In another embodiment of the improved apparatus of the invention, a barrier plate 50 is disposed across the interior of the drum so as to provide an infra red shield and to interrupt the draft of hot gases of combustion from burner 9 at one end of the apparatus to exhaust conduit 50 at the opposite end. The plate preferably has a circular peripheral edge 51 which is spaced from the interior drum surface and lies in a plane extending normal to the elongated drum axis. The distance of the spacing of the barrier or plate edge from the drum surface is not so critical, so long as it is sufficient to allow composition to pass therethrough as it is drawn gravitationally to the output end 17. This separation of the plate peripheral edge may also accommodate lifters which extend along the drum interior as previously explained. The primary purpose of the barrier plate is to provide an infra red shield from radiation from the flame introduced into the input drum end via burner 9 may cause overheating of the very small dust-like asphalt particles. Since, as observed in FIG. 1, these small particles 27 are introduced into the drum and initially cascade through the open drum area, barrier plate 50 provides a screen against this undesired infra red radiation thereby preventing undue overheating of these very fine asphalt containing particles. The plate also interrupts the continuous draft of the gases and provides a rather calm or somewhat still zone adjacent the plate and on the output drum and side thereof.

The purpose for such a calm or still zone with respect to interrupting the exhaust gaseous draft is to prevent very fine composition particles from being picked up and swept away by the draft as they are introduced into the drum and dropped to cascade through the drum interior. Where very fine particles are present, almost as asphalt dust, this material, rich in asphalt, could otherwise be carried away into the exhaust stream, which is undesirable for most efficient processing. Accordingly, in combination with the barrier plate, the preferred apparatus of the invention provides means for introducing the asphalt-aggregate particles of the smallest size range behind the barrier plate, i.e., downstream from the barrier plate and on the side of the output drum end therefrom. This zone will ordinarily be the coolest drum zone in which separate composition particles are introduced. The distance behind the plate in which these fine composition particles are introduced may be selected as desired.

It is also preferred to add make-up asphalt and aromatic softening agent into the composition. The asphalt is preferably added hot so that it can be readily delivered through a pipe 54 having one or more openings 53 or similar means for directing the asphalt into the drum, and preferably sprayed on the composition particles. By adding this make-up asphalt alone, or aromatic hydrocarbon softening agent, or a mixture thereof behind and on the cool side of the barrier plate, any burning or degradation of these materials is avoided. Moreover, a pipe or similar delivery means for these materials preferably extends far enough into the drum so as to allow sufficient mixing of the composition as it is gradually drawn to the output end. Thus, the end of pipe 54 and the openings 53 will deliver the make-up asphalt and/or aromatic softening agent near the zone in which the smallest particles 27 are introduced as shown. The addition of make-up asphalt and aromatic hydrocarbon which has over 55% aromatic content is disclosed in my co-pending application Ser. No. 488,518, filed June 15, 1974, now U.S. Pat. No. 4,000,000, and which description is incorporated herein by reference.

After processing and continued mixing, composition is withdrawn from a port 42 at the output drum end 17 where it may be picked up by a conveyor system 38 and directed for use. These as well as other advantages of the apparatus within the purview of the invention will be evident to those skilled in the art.

I claim:

1. An apparatus for heating and mixing asphalt-aggregate composition comprising:

an elongated rotatable cylindrical drum having means for supplying hot gases of combustion therein at a first end and means for recovering composition at a second opposite end, means for introducing coarse composition particles into said drum in a hot zone adjacent said first end, means for introducing smaller composition particles into said drum in a cooler zone spaced from said first end, and a plurality of lifters secured along the drum interior adjacent the first end and spaced apart from the interior surface.

2. The apparatus of claim 1 wherein said lifters are elongated and extend substantially parallel along a portion of the interior drum length.

3. The apparatus of claim 1 including a plate member secured across the drum interior between said hot zone and said cooler zone and having a peripheral edge spaced apart from the drum interior surface.

4. The apparatus of claim 3 wherein said plate lies along a plane extending normal to the elongated drum axis.

5. The apparatus of claim 3 including means for introducing softening agent and make-up asphalt in said cooler zone.

6. In an apparatus for mixing asphalt-aggregate compositions comprising an elongated cylindrical rotatable drum having means for supplying hot gases of combustion therein adjacent a first end of said drum and which gases are directed through said drum and exhausted adjacent a second end of said drum and in which the mixing composition is directed gravitationally along the drum interior from an input end to an output end the improvement comprising:

means for introducing coarse composition particles into said drum in a hot zone adjacent said first end, a plate member disposed across the drum interior between said first and second ends and having an edge spaced apart from the drum interior whereby composition can pass therebetween, and means for introducing fine composition particles into said drum in a cooler zone behind said plate member from said first end.

7. In a process for recycling asphalt-aggregate composition by introducing coarse composition particles in a hot zone of a heating and mixing apparatus and introducing fine particles in cooler zone of the apparatus, the improvement comprising providing a plate between said hot and cool zones, and introducing said fine particles on the cool side of said plate.

8. The process of claim 7 including adding make-up asphalt and an aromatic hydrocarbon to said composition in the cool side of said plate.

9. In a process for heating and mixing asphalt-aggregate composition comprising directing a flame into a hot end of an elongated cylindrical drum while introducing coarse composition particles into the drum adjacent the hot end and introducing smaller composition particles into the drum in a cooler drum area, the improvement comprising forming an infra red barrier across the drum interior and introducing said smaller composition particles behind said barrier.

* * * * *